United States Patent [19]

Bortner et al.

[11] Patent Number: 4,675,475

[45] Date of Patent: Jun. 23, 1987

[54] ELECTRICAL CABLE WITH REINFORCEMENT

[75] Inventors: Earl D. Bortner; George H. Jenkinson, both of York; Edward A. Paredes, Lancaster, all of Pa.

[73] Assignee: Ericsson, Inc.

[21] Appl. No.: 606,139

[22] Filed: May 2, 1984

[51] Int. Cl.[4] ..... H01B 7/00; H01B 13/06

[52] U.S. Cl. ..... 174/113 R; 156/55; 156/56; 156/172; 174/116

[58] Field of Search ..... 174/113 R, 113 C, 116; 156/55, 56, 172

[56] References Cited

U.S. PATENT DOCUMENTS

| | | | |
|---|---|---|---|
| 1,698,704 | 1/1929 | Middleton et al. | 174/113 R |
| 2,718,544 | 9/1955 | Shepp | 174/113 R |
| 2,744,153 | 5/1956 | Flood | 174/121 R |
| 2,930,837 | 3/1960 | Thompson | 174/115 |
| 3,013,109 | 12/1961 | Gorman et al. | 174/113 R |
| 3,322,889 | 5/1967 | Bird et al. | 174/113 R |
| 3,406,248 | 10/1968 | Bunish et al. | 174/121 R |
| 3,429,984 | 2/1969 | Alexander | 174/115 |

FOREIGN PATENT DOCUMENTS

| | | | |
|---|---|---|---|
| 751673 | 1/1953 | Fed. Rep. of Germany | 174/113 R |

*Primary Examiner*—Morris H. Nimmo

*Attorney, Agent, or Firm*—Pennie & Edmonds

[57] ABSTRACT

An electrical cable includes a core having a plurality of conductors cabled together in a unidirectional lay and a jacket which surrounds the core. The conductors of the core are insulated from one another, and the jacket includes an internal braid or double counter directional serv. The angle of the lay of the conductors and the angle of the braid or serve, both with respect to the longitudinal axis of the cable, is such that the angle of the lay of the conductors is greater than the angle of the lay of the braid or double counter directional serv. The jacket serves an important function as that of primary load-bearing component of the cable and it adapts the cable to withstand severe mechanical and other abuse over a long life.

15 Claims, 2 Drawing Figures

ELECTRICAL CABLE WITH REINFORCEMENT

TECHNICAL FIELD

The invention is in an electrical cable having improved physical properties including an increased capability in loadbearing strength. The cable of the invention also displays a necessary degree of toughness and flexibility under conditions of mechanical abuse, and it is capable of withstanding extreme environmental conditions over a long, useful life.

BACKGROUND OF THE INVENTION

Electrical cables including a core having one or more conductors electrically insulated one from another and a jacket surrounding the core are known. It is also known that a textile serving or braid may be applied over the insulation to add tensile strength to the combined covering. Prior art of this type includes the patent to S. Bunish et al (U.S. Pat. No. 3,406,248). In Bunish et al, the serving is comprised of a fibrous layer in an irregular pattern around and adhered to a layer of insulation. Alexander U.S. Pat. No. 3,429,984, while it relates to a coaxial cable describes a fibrous substrate that is located between a separator and an outer jacket, and bonded to the jacket material to provide the cable with sufficient strength for self support of the cable.

Two other prior art patents which are known are somewhat relevant to the invention. These patents include U.S. Pat. Nos. 2,744,153 to J. E. Flood and U.S. Pat. No. 2,930,837 to P. F. Thompson. According to Flood, an adhesive is applied to a jacket, characterized (by Flood) as an "inner primary jacket" about a conductor, and a serve in the form of a layer of a glass filamentary material is wrapped or wound about the adhesive while in a tacky state. Thereafter, an outer protective insulating jacket is extruded about the inner primary layer and serve. According to Flood, the serve, both securely and firmly positioned about the inner primary layer, is sufficiently strong to resist break down. Thompson discloses a cable structure wherein an open fibrous braid such as a rayon cord having capability of absorbing tensile stress under conditions of twisting, winding, and so forth of the cable, is wrapped about a core. The conductors which make up the core are wrapped with a tape impregnated and coated with a material having adhesive properties, and during the processing of the jacket, each of the tape, fibrous braid and jacket become integrally bonded to each other.

SUMMARY OF THE INVENTION

The electrical cable of the invention because of its various characteristics to be discussed may be used, for example, in applications which demand frequently repeated flexing around drums or rollers and/or application wherein the cable may find itself in long, self-supporting hanging lengths. The cable, by its construction, in addition to withstanding severe mechanical abuse, is also capable of withstanding a wide range of temperatures in these applications of use. Thus, the cable is one which necessarily displays qualities of toughness, flexibility, and a capability of load-bearing strength, all of which assist in extending the useful life of the cable.

The cable includes a core having a plurality of conductors, each of which is covered with a separator tape and an outer layer of insulation, and a jacket including an inner and outer layer with a serve in the form of a braid of a flexible, fibrous, high-strength yarn therebetween. The individual layers and the braid become an integrated unit about the core during the process of applying the outer layer over the inner layer and braid. The integration of layers follows from the action of an adhesive applied over the inner layer.

In a preferred form of the invention, the insulation layer of the core may be a rubber-like material having qualities of toughness and flexibility for physical strength over a wide range of temperatures. The material, further, preferably will be a material which may be extruded. The jacket preferably will be formed of a material which may be extruded as individual layers and formed into an integrated unit, as well as a material capable of protecting the core from external mechanical, chemical and environmental forces.

An important aspect of the invention resides in the manner that the conductors of the core are cabled together. This cabling is both symmetric and in a unidirectional manner at a length of lay which is relatively short to maximize flexibility and optimize flex life without damage to the conductors or insulation. According to this aspect of the invention the lay of the conductors is also at an angle relative to the center line of the cable which is larger than the angle of the lay of the braid of the integrated jacket to the same center line. This particular relationship of conductors and braid insures that the jacket is the primary load bearing component of the cable. Any small amount of stress that is transferred to the core of the cable is accommodated easily by the conductors without the conductors exceeding their allowable mechanical load.

According to this aspect of the invention, the angle of the braid relative to the center line of the cable provides resistance to tension applied along the axis of the cable, as well as resistance to twisting forces which may typically arise in the various applications of use of the cable. The angle of the braid also contributes to the retention of cable flexibility greater than that of cables having tension members which are applied parallel to the axis of the cable. The angle, in addition, imparts to the cable a longitudinal strength to resist a pulling force applied to the jacket which is greater than that exhibited by a cable with spirally wrapped strength members.

The angle of lay of the conductors may be about 25° to about 35°, and the angle of lay of the braid may be about 10° to 20°. In a preferred form of the invention the angles are 30° and 15°, respectively.

These features and other features of the cable render it uniquely superior to provide art cables, such as those generally described above. The other features reside in the separator tape which allows movement between the conductor and the insulation to increase flexibility and flex life. Also, the integration of the inner and outer layers, with the interposed serve, into a bonded jacket unit, assists in the elimination of destructive internal frictional forces which normally occur within jacket systems in which components are free to move when stretched and/or flexed. While the inner and outer layers are integrated in a jacket unit, the jacket unit remains free of the core thereby to function as the primary load-carrying component of the cable. A layer of an inert powder, such as talc applied over the outer surface of the insulation will prevent bonding between the jacket and core, and the talc will also minimize friction between the core and jacket during flexing of the cable.

Other features of the invention will become apparent as the description to be read in conjunction with the drawing figures continues.

DETAILED DESCRIPTION OF THE INVENTION

Figure 1:
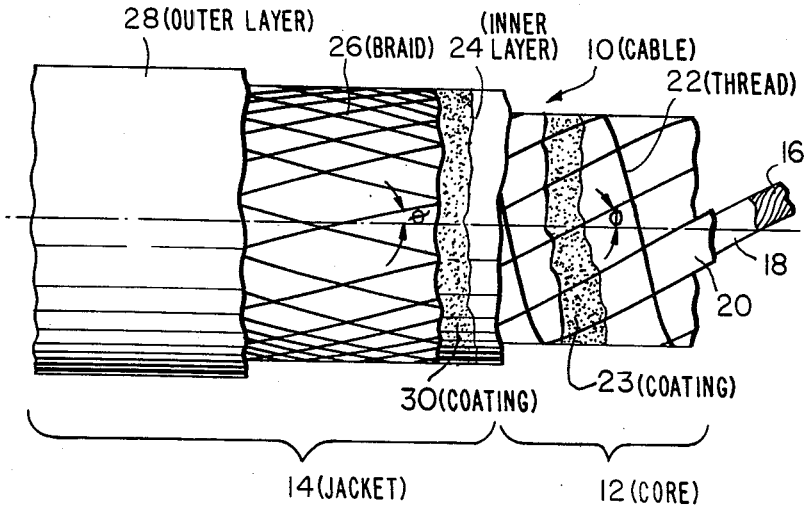
FIG. 1 is side view, partially broken away, of the cable of the invention.
Figure 2:
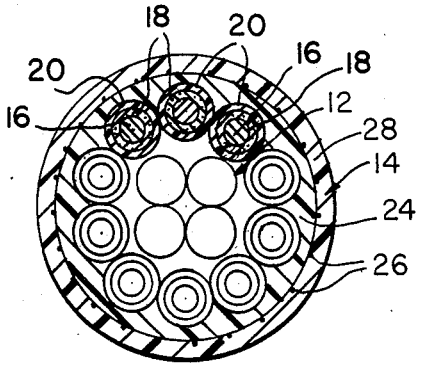
FIG. 2 is a schematic view of the end of the cable of FIG. 1.

The cable 10 illustrated in the Figures includes a core 12 and a jacket 14. The cable is characterized by features of toughness, flexibility, and a good load-bearing strength. And, the cable has a construction which provides protection to the core from external mechanical, chemical and environmental forces over a long life. These forces include but are not limited to those arising from repeated flexing around drums or rollers, the use of the cable in self-supporting hanging lengths, changes in temperature, both indoors and outdoors, over ranges which may be at least as low as −40° C. and at least as high as 90° C., and other severe mechanical abuse.

The core 12 of the cable may include a plurality of flexible, stranded, metallic conductors 16, each of which is wrapped with a tape 18 and coated by insulation 20. The insulation coating preferably comprises a material that may be extruded over the tape. The insulation coating more particularly, may be a rubber-like material, such as a material generally known as a thermoplastic elastomer (TPE), a thermoplastic olefin (TPO), a thermoplastic urethane (TPU), a thermoplastic copolyester or a thermoplastic styrene. A styrene-ethylene, butylene-styrene rubber with fillers is preferred. Typical fillers include process oil, calcium carbonate, polypropylene and antioxidant materials. The insulation coating is characterized by toughness, flexibility, and a capability of withstanding the above-mentioned temperature conditions, and the insulation coating provides a layer of insulation between each conductor 16. The thickness of the coating normally will be in accordance with ICEA (Insulated Cable Engineering Association) standards for portable cables.

The tape may be formed of paper, or a plastic, such as polyester. A tape of paper may have a thickness of about 2 mils, and a tape of plastic may have a thickness of about 1 mil. The tape may be wrapped about the individual conductors in a spiral wrap. The wrap may be edge-to-edge or the adjacent edges of the wrap may overlap. The amount of overlap may be as much as about 25% the width of the tape. The angle of the lay of tape is not important. Actually, the tape may be applied longitudinally, and the longitudinal edge may also overlap. Either manner of application of tape is acceptable. The insulating material is extruded over the conductor substantially simultaneously with the wrapping of the tape. This substantially simultaneous process of wrapping and extruding obviates a need to seal the edges of the tape to maintain the tape in its disposition around a conductor. The tape functions in a manner to permit a measure of relative movement between a conductor and the material of the insulation coating and thereby provides an increase in capability of flex and flex life of the conductors of the core.

The flexibility and flex life of the core may be optimized by cabling the conductors together in a unidirectional manner, with a length of lay illustrated by an angle $\phi$. The angle may be between 25° to 35°. In a cable having ten (10) conductors and an outer diameter of about one inch, the length of the lay may be about ten inches. The length of the lay may be determined by some multiple of the outer diameter. Thus, a cable having ten (10) conductors and an outer diameter of one and one-half inch may have a length of lay of about fifteen inches. The preferred angle $\phi$ may be about 30°.

A binder thread 22 is wrapped about the core. The binder thread serves the function of maintaining the conductors in their cabled condition and, thus, the integrity of the core during the period prior to application of jacket 14. The binder thread may be a cotton thread. Once the jacket is applied over the core, the binder thread is no longer required. Thus, it matters not whether the binder thread should deteriorate or otherwise break.

The drawing, see FIG. 1, illustrates the binder thread in a widely spaced, spiral wrap. The wide spacing limits the amount of core which is covered to the material of jacket 14 which then may be extruded easily into the outer layer interstices between conductors 16. A coating (not shown) of an inert material, such as talc is applied on all layers to reduce friction between conductors due to relative motions induced by flexing and over the core 12 to prevent material of jacket 14 from bonding to the core.

Jacket 14 includes an inner layer 24 and an outer layer 28. Both the inner and outer layers are formed of a plastic material capable of being extruded. The inner layer, thus, is extruded about the core 12, while the outer layer is extruded about the inner layer and a serve in the form of a braid 26 about the inner layer.

The jacket may be formed of a thermoplastic or a thermosetting plastic. The jacket may be formed of polyurethane in the form of polyisocyanate reacted with linear polyester or polyether containing hydroxyl groups, or the jacket may be formed of polyvinyl chloride or a polyolefin, such as polyethylene. An ester base polyurethane has been found to provide the desired features, above, and is preferred. The jacket 14 normally will have a thickness according to ICEA (S61-402) standard for portable cable jackets. The inner layer 24 may comprise about one-half the overall thickness of jacket 14, and the outer layer 28 may comprise the other one-half portion.

An important aspect of the invention is directed to the load-carrying capacity of cable 10, a capacity which primarily resides in jacket 14. The construction of the cable, as described above and as will be further described below, prevents any major transfer of stress or load that the cable may sustain to the core 12, and any small amount of stress which is transferred to the core 12 will be accommodated by the conductors 16 within their allowable maximum load carrying capability.

This important aspect of the invention is achieved, at least in part, by the braid 26 within the jacket, between the inner and outer layers, and the disposition, or lay of the braid relative both to the longitudinal axis of core 12 and the lay of the conductors 16 in the core. Since the braid is substantially immobilized in the position between the layers, and since the conductors are also substantially immobilized, the relative relationship between the braid and conductors will be maintained over the life of the cable. The immobilized components of the cable will maintain the relationship that the angle $\phi$ is greater than the angle $\phi$.

The braid 26 is formed by a material having good resistance to tension applied along the axis of the cable as well as resistance to twisting forces which are typical in cable applications, such as described herein. One form of material which has provided good results is an aramid fiber, such as a fiber manufactured by E. I. DuPont de Nemours & Co. of Wilmington, Delaware, under the trademark KELVAR. This fiber is also characterized by flexibility, and it displays highstrength, without stretch. In contrast, prior art fibers, such as fibers of rayon or nylon have been found lacking in strength characteristics, and a resistance to stretch before reaching the tension point. In the preferred form of the invention, the braid may include a plurality, for example, twelve individual fibers wrapped about the inner layer 24. A conventional braider may be used to complete the serve.

The braid 26 is applied to the inner layer 24 of the jacket 14 at an angle $\phi$. The angle may be about 10°0 to 20°, and preferably 15°. This angle of braid has been found to provide a break strength which is required to meet the various application specifications of use of the cable. The break strength may be increased by increasing the diameter of the fiber (from about 0.090 inch) or by increasing the number of fibers in the serve. The preferred angle of the fibers of the braid contributes to the maintenance of flexibility in the cable. As indicated, the flexibility is greater than that achieved in cables having tension members which are applied as a family of fibers parallel to the axis of the cable.

The braid 26 is substantially immobilized in the position at which it is wrapped around the inner layer 24 of jacket 14. The immobilization of the braid is accomplished by bonding the inner layer to the outer layer 28 in the integration of the jacket unit. An adhesive 30 may be applied to the outer surface of the inner layer 24, and the material of the layers essentially bonds under the influence of the heat acting on the adhesive. The adhesive may be a polyurethane, heat-activated adhesive (by the heat of extrusion about 350° F.). By bonding the inner and outer layers, thereby to integrate the jacket unit it is possible to overcome destructive internal frictional forces which normally occur within jacket systems wherein components are free to move when stretched and/or flexed.

Rather than braiding, the said yarn may be applied in a non-braided fashion wherein the family of yarns of an outer layer is wrapped over a second family of yarns of an inner layer with both being applied at the same angle $\phi$ to the longitudinal axis of the cable. The materials, number, and size of said individual fiber yarns; and the angle of application of said counter-directionally wrapped servings are identical to those described in the braided method heretofore discussed.

We claim:

1. An electrical cable including a core and a jacket, said core formed by a plurality of insulated conductors cabled together in a unidirectional wrap, said conductors being located generally at a first acute angle relative to the longitudinal axis of said core, a braid of high tensile strength yarn embedded in said jacket, and said braid being braided at a second acute angle relative to said longitudinal axis less than said first acute angle whereby said braid provides said cable with the primary resistance to tension along said longitudinal axis.

2. The cable of claim 1 wherein said braid is comprised of at least twelve aramid fibers having a diameter of about 0.090 inch.

3. The process of forming a cable including a core having a plurality of conductors and a jacket wherein said jacket comprises the component of said cable having the primary load-carrying function, said process including the steps of wrapping said conductors in a unidirectional manner and at a first acute angle relative to the longitudinal axis of said core, forming a first layer of material of said jacket about said conductors, braiding a high tensile strength yarn about said first layer, said yarn being braided at a second acute angle, less than said first acute angle, relative to said axis, and forming a second layer of said material about said first layer and braided yarn.

4. The process of claim 3 further including applying a layer of inert material over said core to prevent said jacket from bonding to said core.

5. The process of claim 3 wherein said first and second layers of said jacket are extruded about said core.

6. The process of claim 4 further including applying an adhesive layer on said first layer, and subjecting said first and second layers to a temperature of about 350° F. to bond said layers together to form an integral jacket unit having an embedded braided yarn.

7. An electrical cable including a core and a jacket, said core formed by a plurality of insulated conductors cabled together in a unidirectional wrap, said conductors being located generally at a first acute angle relative to the longitudinal axis of said core, a double counter wrapped serving of high tensile strength yarn embedded in said jacket and each said layer of the double serving being located to form a second acute angle relative to said longitudinal axis less than said first acute angle whereby said double serving provides said cable with the primary resistance to tension along said longitudinal axis.

8. The cable of claim 7 wherein said double counter wrapped serving is comprised of at least twelve aramid fibers having a diameter of about 0.090 inch.

9. The cable of claim 1 or 7 wherein said jacket is located along the interstices of said cabled conductors, and a layer of an inert material between said jacket and core to prevent said jacket from bonding to said core.

10. The cable of claim 1 or 7 wherein said first acute angle is between 25° and 35° and said second acute angle is between 10° to 20°.

11. The cable of claim 10 wherein said first acute angle is 30°, and said second acute angle is 15°.

12. The cable of claim 1 or 7 wherein each conductor of said core has a tape layer and an outer insulative layer capable of movement relative to said conductor to increase flexibility and flex life of said core.

13. The cable of claim 12 wherein said outer insulative later is a rubber-like material selected from the group consisting of thermoplastic elastomer, a thermoplastic olefin, a thermoplastic urethane, a thermoplastic copolyester, and a thermoplastic styrene.

14. The cable of claim 13 wherein the insulative layer is a thermoplastic material selected from a group consisting of styrene-ethylene and butylene-styrene rubber including a filler.

15. The cable of claim 1 or 7 wherein said jacket is a polyurethane material formed of a material selected from the group consisting of polyisocyanate reacted with linear polyester containing hydroxyl groups and linear polyether containing hydroxl groups.

* * * * *